US009334861B2

(12) United States Patent
Berg et al.

(10) Patent No.: US 9,334,861 B2
(45) Date of Patent: May 10, 2016

(54) SINGLE CYLINDER TREADLE PUMP

(71) Applicant: Brooklyn Bridge to Cambodia, Inc., Brooklyn, NY (US)

(72) Inventors: Ian Charles Edwin Berg, Arlington Heights, IL (US); Anthony Robert Cerqua, Kildeer, IL (US); Bryce Austell, Chicago, IL (US); Kenneth Long, Carollton, TX (US); Joseph Colmone, Arlington Heights, IL (US)

(73) Assignee: Brooklyn Bridge to Cambodia, Inc., Brooklyn, NY (US)

( * ) Notice: Subject to any disclaimer, the term of this patent is extended or adjusted under 35 U.S.C. 154(b) by 171 days.

(21) Appl. No.: 13/799,497

(22) Filed: Mar. 13, 2013

(65) Prior Publication Data

US 2014/0271241 A1 Sep. 18, 2014

(51) Int. Cl.

| | |
|---|---|
| ***F04B 47/02*** | (2006.01) |
| ***F04B 53/14*** | (2006.01) |
| ***F04B 33/00*** | (2006.01) |
| ***F04B 9/14*** | (2006.01) |

(52) U.S. Cl.

CPC . *F04B 53/14* (2013.01); *F04B 9/14* (2013.01); *F04B 33/00* (2013.01); *F04B 47/024* (2013.01)

(58) Field of Classification Search

CPC ..... F04B 33/00; F04B 9/14; F04B 47/024; F04B 53/14; F04B 53/147; F03C 1/007

USPC ..... 417/533, 534, 539, 544, 903; 277/340, 277/341, 395

See application file for complete search history.

(56) References Cited

U.S. PATENT DOCUMENTS

| | | | | |
|---|---|---|---|---|
| 3,730,651 | A * | 5/1973 | Ellis | 417/554 |
| 7,396,218 | B2 * | 7/2008 | Hyde et al. | 417/534 |
| 2011/0250080 | A1 * | 10/2011 | Spybey et al. | 417/305 |

OTHER PUBLICATIONS

Author: Practical Action Nepal Title: Treadle Pumps Year Published: 2010 Date Accessed: Jan. 26, 2015 Website link: http://www.worldwidehelpers.org/wwhweb/uploads/files/KnO-100434_Treadle%20Pumps.pdf.*

Author: Kay, M and Bradden, T Title: Treadle pumps for irrigation in Africa Year Published: 2000 Date Accessed: Jan. 26, 2015 Website link: http://www.fao.org/docrep/005/X8293E/X8293E00.HTM.*

Author: Eschenbach, W Title: Wind systems for pumping water: A training manual Date Published (mm/yyyy): May 1984 Date Accessed: May 29, 2015 Website link: http://www.fastonline.org/CD3WD_40/CD3WD/APPRTECH/T0025E/EN/B1197_14.HTM.*

(Continued)

*Primary Examiner* — Devon Kramer
*Assistant Examiner* — Chirag Jariwala
(74) *Attorney, Agent, or Firm* — Covington & Burling LLP; Enrique D. Longton; Grant D. Johnson

(57) ABSTRACT

A human-powered positive-displacement single dual-action cylinder treadle pump for use in pumping and distributing water from wells and other water sources, as well as methods of manufacturing and operating such a pump. The pump offers rural farmers a portable device for pumping water for use in irrigating fields and crops that is powerful, low-cost, modular and portable. The modularity of the pump allows for easy access to any of the components of the pump should they require maintenance, repair or replacement.

32 Claims, 11 Drawing Sheets

(56) References Cited

OTHER PUBLICATIONS

Author: Kay, M and Bradden, T Title: Treadle pumps for irrigation in Africa Year Published: 2000 Date Accessed: Jan. 26, 2015 Website link: ftp://ftp.fao.org/agl/iptrid/kn_syn_01.pdf.*
Author: Klenck, T Title: PM's Guide to Garden Hoses Date Published: Dec. 7, 2004 Date Accessed: Jan. 27, 2015 Website link: http://www.popularmechanics.com/home/improvement/lawn-garden/1273576.*
Author: Practical Action Nepal Title: Treadle Pumps Year Published: 2010 Date Accessed: Jan. 26, 2015 Website link: http://www.worldwidehelpers.org/wwhweb/uploads/files/KnO-100434_Treadle/%20Pumps.pdf.*
Author: Seago, C and de Lange, M Title: The development of a Treadle Pump Year Published: 2003 Date Accessed: Feb. 2, 2015 Website link: https://ideas.repec.org/p/iwt/bosers/h032466.html.*
Author: Jim and Larry Title: Pistons and Leather Cup Seals Date Published (mm/dd/yyyy): Dec. 15, 2008 Date Accessed: May 29, 2015 Website link: https://sites.google.com/site/treadleplans/pistonsandseals.*
Author: Longenecker, J Title: PVC Water Pumps Date Published: Sep. 2010 Date Accessed: Jan. 27, 2015 Website link: http://c.ymcdn.com/sites/www.echocommunity.org/resource/collection/C01889C5-4BB2-424C-962F-F5B14EF26E69/PVC_Water_Pumps.JBL.pdf.*
Author: O'Keefe, W Title: Check Valves Date Published: Aug. 1976 Date Accessed: Jan. 27, 2015 Website link: http://water.me.vccs.edu/courses/CIV240/lesson29_print.htm.*
Author: USAID Title: Treadle Pump Installlation and Maintenance Manual Date Published: Feb. 2009 Date Accessed: Jan. 27, 2015 Website link: http://pdf.usaid.gov/pdf_docs/pnaeb714.pdf.*
Author: Smitty Title: Shop Made Check Valves Date Published: Jul. 8, 2007 Date Accessed: Feb. 2, 2015 Website link: http://treadlepump.blogspot.com/2007/07/shop-made-check-valves.html.*
Title: piston and leather cup seals search on Google (Custom date search) Link: https://www.google.com/search?q=piston+and+leather+cup+seals&es_sm=122&biw=1745&bih=970&source=lnt&tbs=cdr%3A1%2Ccd_min%3A12%2F14%2F2008%2Ccd_max%3A12%2F16%2F2008&tbm=.*
Final Report, University of Illinois at Urbana-Champaign Department of Mechanical Science & Engineering (Apr. 29, 2012).
PowerPoint Presentation of "Final Report: Sustainable Water Pump for Cambodia", University of Illinois at Urbana-Champaign Department of Mechanical Science & Engineering (May 1, 2012).

* cited by examiner

SINGLE CYLINDER TREADLE PUMP

TECHNICAL FIELD

The present invention pertains to a human-powered apparatus for pumping and distributing water, as well as to methods of operating and manufacturing such an apparatus. More particularly, the present invention is directed towards a positive-displacement treadle pump comprising a single dual-action piston cylinder that is utilized to pump and distribute water, as well as methods of operating and manufacturing such a single-cylinder treadle pump.

BACKGROUND OF THE INVENTION

In rural areas of the developing world, billions of people remain mired in poverty and dependent upon small, subsistence-level farms as their only source of food. These subsistence farmers, reliant on their harvests to feed themselves and their families, lack the agricultural equipment needed to increase the productivity of their harvests. The low productivity of these subsistence farms means that farmers are unable to grow any surplus of produce that could be sold at the marketplace, preventing these farmers from earning the income that would allow them to invest in their farms, purchase healthcare and education for themselves and their families, and progress out of poverty towards the middle class.

Cambodia, one of the poorest countries in Asia, presents a vivid illustration of the plight faced by Third World subsistence farmers. Plagued by decades of conflict, almost eighty percent of Cambodia's population lives in rural areas, with most relying on farming as their only source of food and income. Dependent on their harvests to feed their families, many Cambodian farm families suffer from malnutrition and lack basic human necessities such as healthcare and educational opportunities.

In addition to its low levels of income, Cambodia's environment presents further challenges to would-be farmers. Agriculture in Cambodia consists almost entirely of the cultivation of rice with no rotation of other crops, which has resulted in high levels of soil degradation. Furthermore, the geographical location of Cambodia has left its farmers dependent on the yearly monsoon, which only provides sufficient levels of irrigation for seven months each year. During the five-month dry season, the water table sinks to seven meters below the surface, making it extremely difficult for farmers to irrigate their fields and grow crops, such as vegetables, that can serve as an alternative to the rice that has so severely depleted the soil.

A solution to the challenges faced by Cambodian farmers is the development and distribution of human-powered pumps which would enable these farmers to access water from wells during the dry season for use in irrigating their fields. Such a pump would enable these farmers to grow crops like vegetables year-round, nourishing the soil that has been degraded by rice monoculture and providing greatly improved yields that can raise the income of farmers and lift them and their families out of poverty.

To be effective in Cambodia, where farmers often travel several miles to fields by motorcycle, a pump must be relatively lightweight and compact, so that it can be transported by motorbike to the field and then carried by hand to the location of the well or other water source. Additionally, the pump must have sufficient power to pump water from at least seven vertical meters below ground, the average depth of the water table of the Tonle Sap and Mekong floodplains of Cambodia during the dry season, and to distribute that water over the surface area of a field up to one hectare in size.

While many varieties of water pumps exist, no known existing designs are sufficient to meet the needs of would-be Cambodian farmers. Bucket pumps and rope pumps that can draw water from wells are immovable, limited to use at the single location of the well where they are constructed, and result in farmers being forced to carry buckets of water to their fields. Centrifugal pumps, which are widely used by farmers in developed nations, must be cast out of metal using specialized manufacturing equipment unavailable in developing nations such as Cambodia. Diaphragm pumps require specialized types of rubber with unique properties, material which is unavailable and too expensive to rural farmers in developing nations.

Several varieties of pumps exist that seek to address the irrigation needs faced by the rural farmers of Cambodia. One such pump, the MoneyMaker, has been developed by the organization KickStart International. However, this device fails to solve challenges faced by Cambodian farmers. Manufactured from stainless steel and featuring two piston cylinders, the KickStart pump is made of materials unavailable to local Cambodian manufacturers, and therefore must be manufactured in foreign countries such as China. The amount and type of materials required to construct this pump design make the pump too expensive to be affordable to rural Cambodians, especially when shipping costs and tariffs are taken into consideration. Additionally, vital components of this pump design are inaccessible to users wishing to perform maintenance or repair. The valves of the MoneyMaker pump, for example, are located in a welded box and cannot be accessed for replacement or repair. Therefore, if these components fail, the entire pump must be replaced, not just the damaged component. What is needed is a pump having modular components such that individual parts may be removed from the pump should they require maintenance, repair or replacement.

As discussed above, existing devices for pumping water suffer from many deficiencies. Existing water pumps that are made of materials accessible and affordable to rural farmers in developing countries are immobile and must be constructed to serve a specific well, leaving farmers forced to carry buckets of water to their fields no better off than before. Existing designs for more mobile and lightweight pumping devices are too expensive to import and too complex to manufacture in developing nations, and the components of these designs are difficult to repair or replace. As a result, there remains a need for a water pump that does not suffer from the drawbacks common to these existing water pump designs. The present invention, described in detail below, solves the need in the art for such a device.

SUMMARY OF THE INVENTION

The present invention is directed, in certain embodiments, to human powered apparatuses for pumping and distributing water. In an embodiment, the apparatus comprises a frame, two treadles, and a pump, wherein the pump is a positive-displacement pump which comprises a single dual-action cylinder, a piston, piping, and a plurality of valves.

In certain embodiments of the invention, the apparatus further comprises hosing. In further embodiments of the invention, the hosing comprises an inlet hose and an outlet hose. In still further embodiments of the invention, the inlet hose and the outlet hose are vinyl hoses.

In certain embodiments of the invention, the inlet hose is fixed to a water source. In further embodiments of the invention, the water source is a well. In still further embodiments of the invention, the well is a small diameter tube well.

In certain embodiments of the invention, the apparatus weighs less than twenty kilograms.

In certain embodiments of the invention, the apparatus is capable of vertically propelling water at least seven meters and horizontally propelling water at least a hundred meters.

In certain embodiments of the invention, the apparatus further comprises fittings.

In certain embodiments of the invention, the frame is comprised of materials such as, but not limited to steel, iron, PVC, angle iron, steel channel, solid steel rod, wood, and bamboo, for example. In certain other embodiments of the invention, the treadles are comprised of materials such as, but not limited to steel, iron, steel channel, angle iron, wood, and bamboo, for example.

In certain embodiments of the invention, the plurality of valves are swing-check non-return valves or lift-check non-return valves. In certain further embodiments of the invention, each of the plurality of valves is a lift-check non-return valve, and the lift-check non-return valve comprises a valve plate comprising a first disc containing holes spaced symmetrically around the center of the first disc, a second disc of a size sufficient to simultaneously cover all of the holes spaced symmetrically around the center of the first disc, wherein the second disc is positioned on a first side of the valve plate, and a bolt inserted through both a hole located in the center of the valve plate as well as a hole located in the center of the second disc, the bolt comprising a head larger than the hole located in the center of the valve plate, wherein the head of the bolt is positioned on a second side of the valve plate. In still further embodiments of the invention, the first disc is comprised of flattened PVC, and the second disc is comprised of rubber and flattened PVC.

In certain embodiments of the invention, the plurality of valves are comprised of materials such as, but not limited to PVC, uPVC, molded plastic, steel, and rubber. In certain other embodiments of the invention, the piston is comprised of materials such as, but not limited to PVC, uPVC, molded plastic, steel, and rubber, for example.

In certain embodiments of the invention, the piping is PVC piping or uPVC piping. In certain further embodiments of the invention, the PVC piping has an inner diameter of about 0.5 inches to about 2.5 inches.

In certain embodiments of the invention, the apparatus is capable of pumping water at a flow rate of at least 35 liters per minute.

In certain embodiments of the invention, the two treadles are connected to the frame by a rocker, and the two treadles are connected to the pump by a piston rod.

In certain embodiments of the invention, the frame comprises a handle, a housing, and a support.

In certain embodiments of the invention, the dual-action cylinder is comprised of a material selected from the group consisting of PVC, uPVC, and molded plastic.

The present invention is directed, in certain embodiments, to methods of pumping and distributing water using a human powered apparatus, comprising priming a pump of the apparatus by manually inserting water into the pump while simultaneously operating the pump, and pumping water using the apparatus by operating the two treadles of the apparatus. In further embodiments of the invention, manually inserting water into the pump comprises pouring about 1 liter to about 5 liters of water into the pump.

In certain embodiments of the invention, the methods further comprise the step of attaching the pump to inlet hosing fixed to a water source before priming the pump.

The present invention is directed, in certain embodiments, to methods of manufacturing a human powered apparatus for pumping and distributing water, comprising welding a frame together, welding each of two treadles together, manufacturing circular discs of PVC for use in a piston and in a plurality of valves, wherein the manufacturing of circular discs comprises heating PVC pipe to above the glass transition temperature of PVC, pressing the heated PVC pipe between flat glass plates and allowing the heated PVC pipe to cool into a flattened PVC sheet, and cutting circular discs from the flattened PVC sheet, assembling the plurality of valves, gluing the plurality of valves to the piping, and connecting the frame, treadles, and pump to assemble the apparatus. In further embodiments of the invention, the PVC pipe is heated using an oven.

In certain embodiments of the invention, a coating is applied to the pump to prevent degradation from ultraviolet rays. In further embodiments of the invention, the coating is a water-based latex paint.

DETAILED DESCRIPTION OF THE INVENTION

Figure 1A:
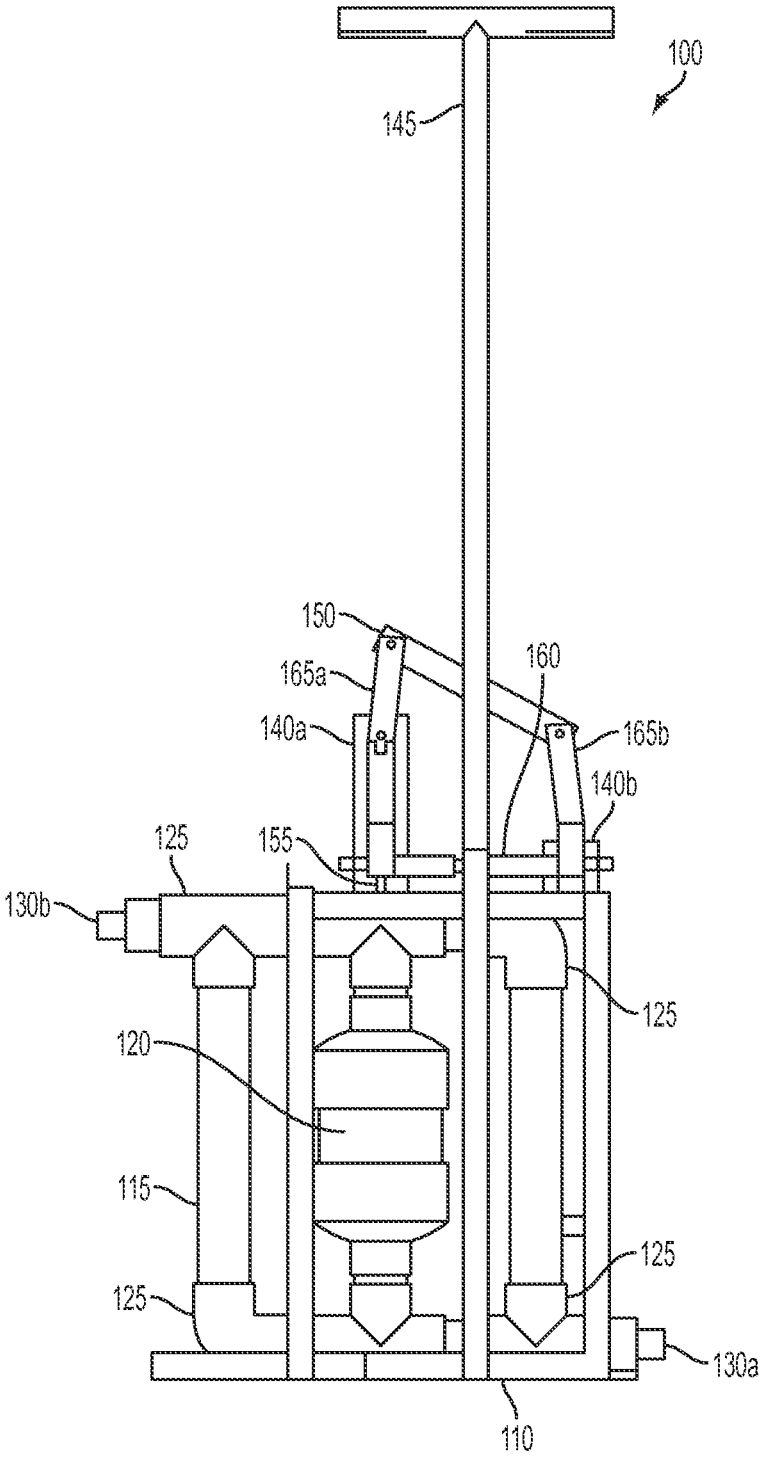
FIG. 1A depicts a front view of an exemplary treadle pump, the treadle pump comprising a positive-displacement pump with a single dual-action piston cylinder, piping, two treadles, and a frame.

The present invention is directed to a modular human powered apparatus for pumping and distributing water, as well as to methods of manufacturing and operating such an apparatus. One embodiment of the invention is a human powered apparatus for pumping and distributing water, comprising a frame, two treadles, and a positive-displacement pump with a single dual-action cylinder. The components of the pump are modular for ease of access should any of the components of the pump or apparatus require repair, maintenance or replacement. The modularity of the apparatus and pump make it especially useful, practical and superior to other pumps.

Another embodiment of the invention is a method for pumping and distributing water utilizing the human powered apparatus, comprising the steps of priming the pump of the apparatus and operating the two treadles of the apparatus to pump water. A third embodiment of the invention is a method for manufacturing the human powered apparatus, comprising the steps of welding the frame and each of the two treadles together, manufacturing circular discs of PVC for use as the piston and the plurality of valves, assembling the plurality of valves, gluing the plurality of valves to the piping, and connecting the frame, treadles, and pump to assemble the apparatus.

A "treadle pump" may be, for example but not limited to, a human-powered suction pump powered by levers known as "treadles" upon which an operator stands. As the operator steps up and down on the treadles using his or her body weight and leg muscles, the treadles drive one or more pistons, creating suction that draws water and propels the water from the pump.

Frame and Treadles of the Apparatus

In one embodiment of the present invention, and as illustrated in FIGS. 2A-2E, a human-powered apparatus 200 for pumping and distributing water comprises a frame. In embodiments of the present invention, the frame is comprised of angle iron, steel channel, and solid steel rod. However, the frame of these embodiments is not limited to these particular materials for use in the frame. Indeed, the frame of the present invention could be comprised of many different materials including, but not limited to, steel, iron, PVC, angle iron, steel channel, solid steel rod, wood, and bamboo, for example.

In embodiments of the present invention, the frame comprises a handle 205, a housing 230, and supports 210, 215, 220, 245 and 280. In some embodiments, the handle 205 of the frame is comprised of steel. However, the handle 205 could be comprised of a number of different materials, including, but not limited to steel, iron, PVC, angle iron, steel channel, solid steel rod, wood, and bamboo, for example. The handle 205 can be gripped by the person operating the apparatus 200 while standing on the treadles 225*a* and 225*b* to aid with balance and support while that person operates the treadles 225*a* and 225*b* to pump water using the apparatus 200.

In embodiments of the present invention, the housing 230 of the frame is of sufficient size to enclose a pump. In one embodiment of the invention, the housing 230 of the frame is comprised of two halves, which slide apart off of bolts, enabling the pump to be moved in and out of the housing 230. However, the housing 230 could also comprise a single solid piece. In another embodiment of the invention, a slit or groove is cut into the housing 230, enabling a pump to be more easily slid into and removed from the housing structure 230. In this embodiment, the modular design of apparatus 200 allows the pump to be removed from housing 230 for maintenance, repair, or replacement of the pump's components without damaging the housing 230 or other components of the frame.

In some embodiments of the invention, the dimensions of the housing 230 are at least small enough to fit inside a 1.0 meter by 0.5 meter by 0.75 meter volume. However, the dimensions of the housing 230 of the apparatus 200 could be greater or smaller depending on the size of the pump to be enclosed, the weight required to be supported by the frame, the portability of the frame (involving considerations of both weight and size), and other practical engineering considerations. In this embodiment of the present invention, the housing 230 of the frame may be constructed from 1 inch×1 inch angle iron welded together into a rectangular structure. However, the housing 230 could be constructed from a variety of materials of varying dimensions, including but not limited to steel, iron, PVC, uPVC, angle iron, steel channel, solid steel rod, wood, and bamboo, for example, and that the housing 230 could be assembled using different techniques. Likewise, the housing 230 could be differently shaped than the rectangular box of the embodiment of the apparatus 200 illustrated in FIGS. 2A-2E.

In embodiments of the invention, the supports 210, 215, 220, 245 and 280 of the frame enable the frame to bear the weight of the one or more operators of the pump. In one embodiment of the invention, the supports 210, 215, 220, 245 and 280 are capable of supporting a weight of at least 70 kilograms. In another embodiment of the invention, the supports 210, 215, 220, 245 and 280 are capable of supporting a weight of at least 100 kilograms. In yet another embodiment of the invention, the supports 210, 215, 220, 245 and 280 are capable of supporting a weight of at least 125 kilograms.

In embodiments of the invention, the supports 210, 215, 220, 245 and 280 are comprised of three components: an operator support 210 and 215, a back support 220 and 280, and a rocker support 245. In some embodiments of the invention, the operator support 210 and 215 comprises a T-shaped piece 210 of 1 inch×1 inch angle iron extending, parallel to the ground, from the bottom of the front of the housing 230. The T-shaped piece 210 is positioned underneath the treadles 225*a* and 225*b* upon which the operator of the apparatus 200 stands, and is designed to bear the weight of the operator. In embodiments of the invention, a member of 1 inch×1 inch steel channel 215 also makes up part of the operator support, extending diagonally from the top of the front of the housing 230 to the middle of the T-shaped piece of angle iron 210, and provides additional vertical support of the operator's weight to the apparatus 200.

In embodiments of the invention, the back support comprises a horizontal member 280 of 1 inch×1 inch steel channel extending, parallel to the ground, from the bottom of the rear of the housing 230, and a member of 1 inch×1 inch steel channel 220 extending vertically from the horizontal member 280 to support a pivot 235 upon which the treadles 225*a* and 225*b* of the apparatus 200 rotate. In some embodiments of the invention, for example, the horizontal member 280 may be V-shaped, and the vertical member 220 extends vertically from the base of the V-shaped member 280. The rocker support 245 comprises a member of 1 inch×1 inch steel channel, extending vertically from the center of the frame housing 230 and supporting the rocker 240 to which the treadles 225*a* and 225*b* are attached.

The support pieces 210, 215, 220, 245 and 280 of the frame could be constructed from any material of varying dimensions such as, but not limited to steel, iron, PVC, uPVC, angle iron, steel channel, solid steel rod, wood, and bamboo, for example, and assembled using different techniques. Likewise, the support components 210, 215, 220, 245 and 280 of the frame could be shaped differently than the supports 210, 215, 220, 245 and 280 of the design of the particular exemplary embodiments discussed above.

In one embodiment of the present invention, a human-powered apparatus 200 for pumping and distributing water comprises two treadles 225*a* and 225*b*. In some embodiments, the treadles 225*a* and 225*b* are comprised of 1 inch×2 inch steel channel with a total length of 32 inches and a pedal length of 13 inches. However, the treadles 225*a* and 225*b* could be of different dimensions, depending on the maximum size of the pump, the number of users of the pump, the size of the pump operator's feet, the weight of the pump operator, and/or additional engineering considerations. Moreover, the treadles 225*a* and 225*b* could be comprised of any material such as, but not limited to steel, iron, steel channel, angle iron, other metals, wood, and bamboo, for example.

Pump of the Apparatus

Figure 2A:
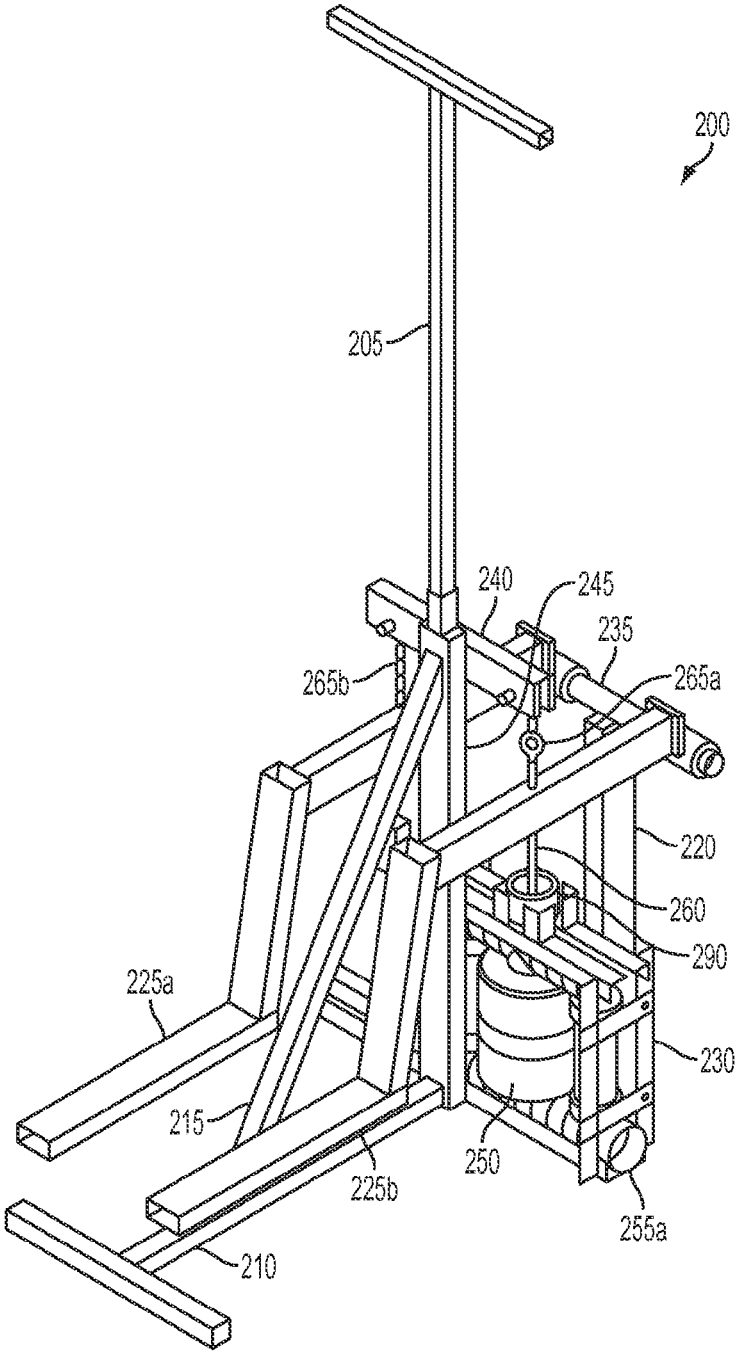
FIG. 2A depicts a perspective view of an exemplary treadle pump, the treadle pump comprising a positive-displacement pump with a single dual-action piston cylinder, piping, two treadles, and a frame.
Figure 2B:
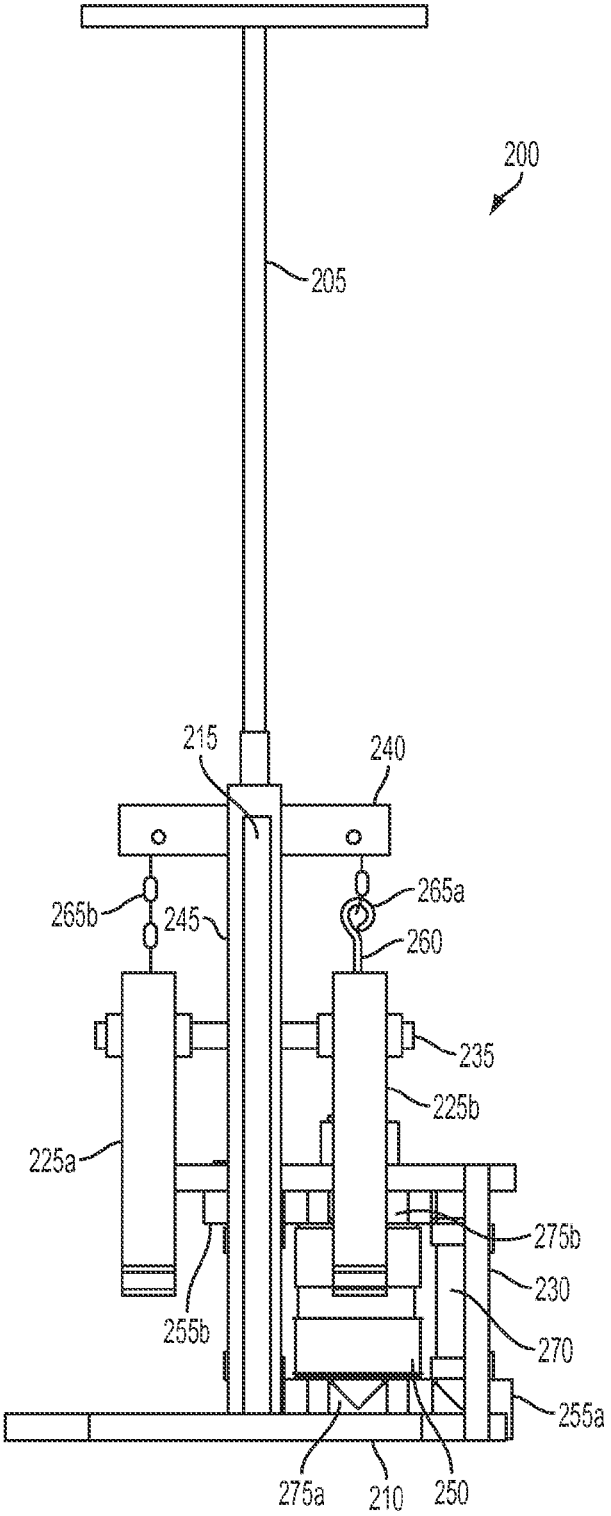
FIG. 2B depicts a front view of the exemplary treadle pump of FIG. 2A.
Figure 2C:
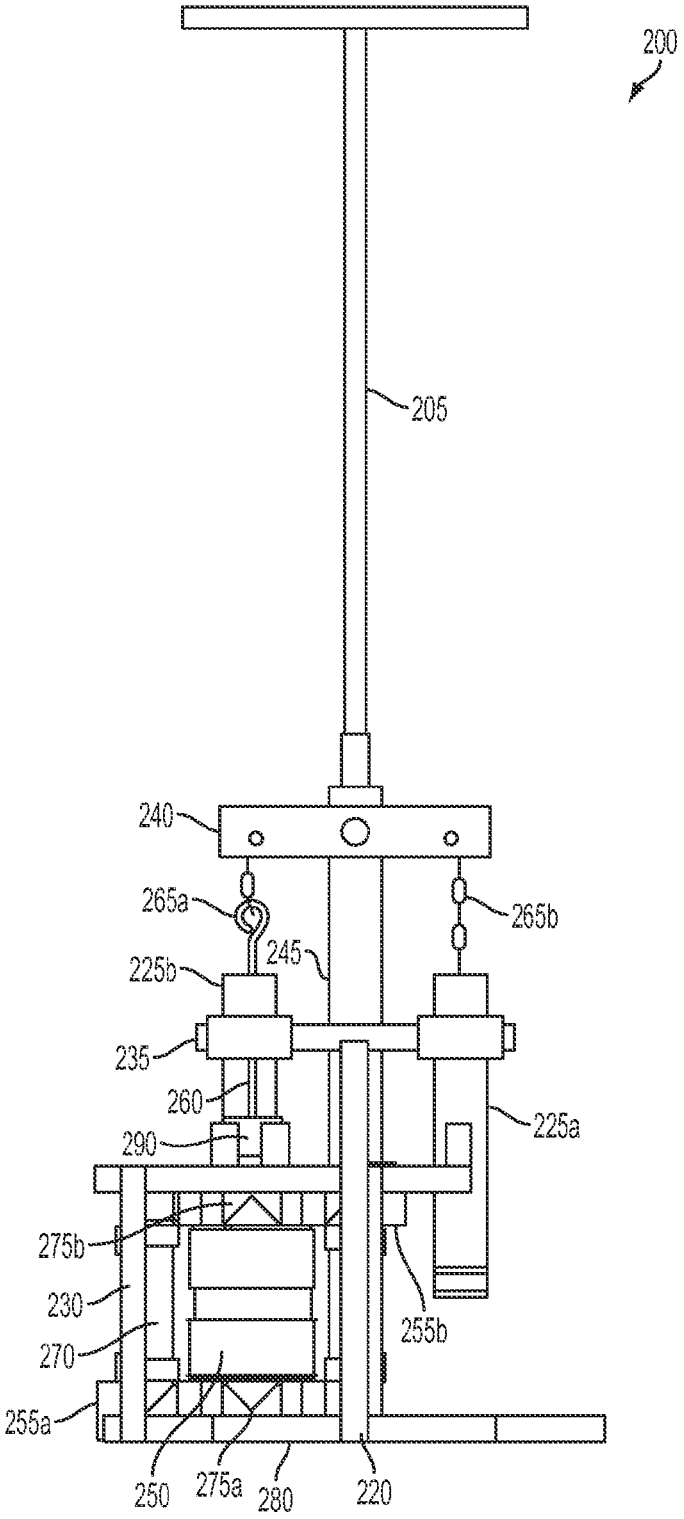
FIG. 2C depicts a rear view of the exemplary treadle pump of FIG. 2A.
Figure 2D:
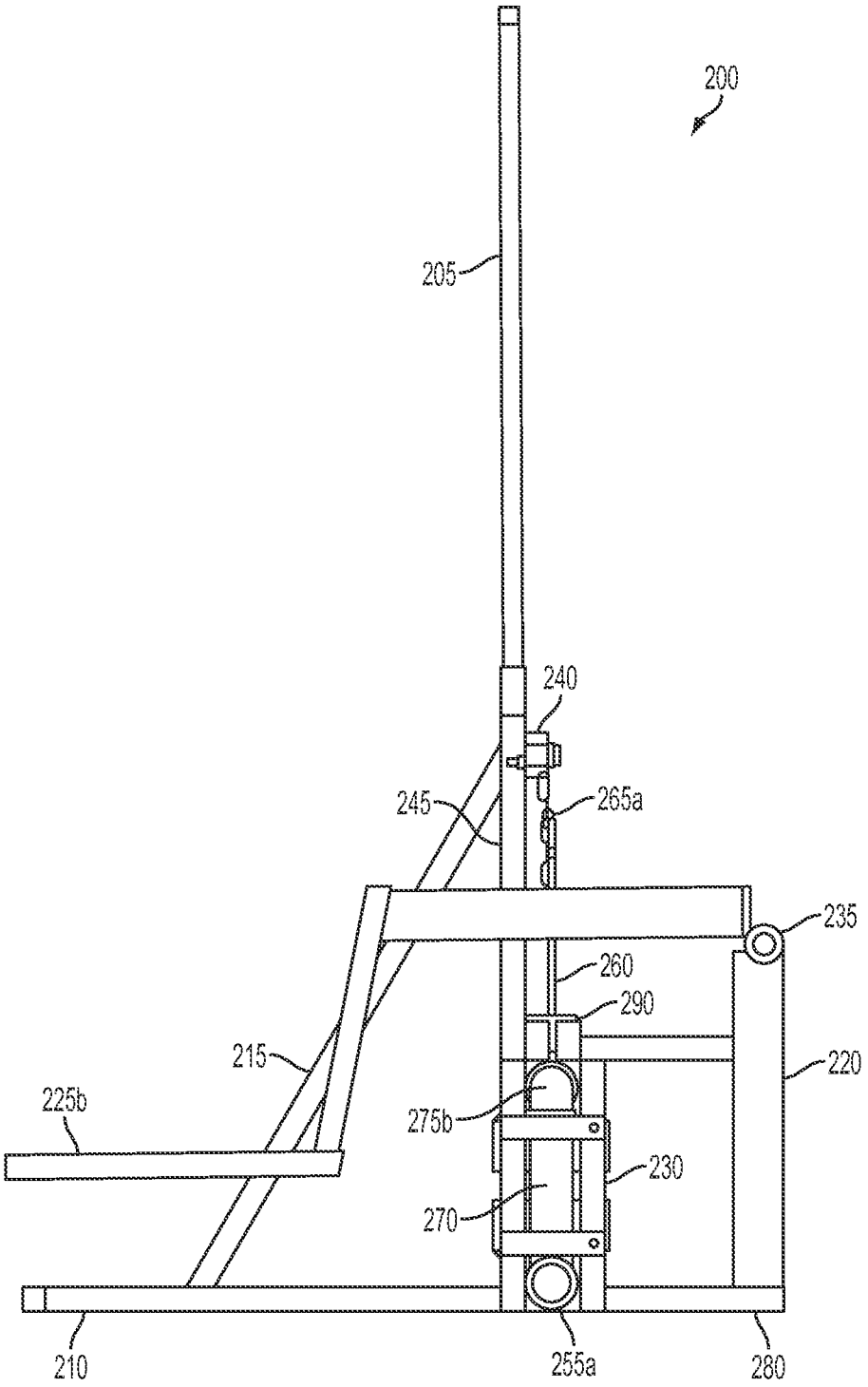
FIG. 2D depicts a side view of the exemplary treadle pump of FIG. 2A.
Figure 2E:
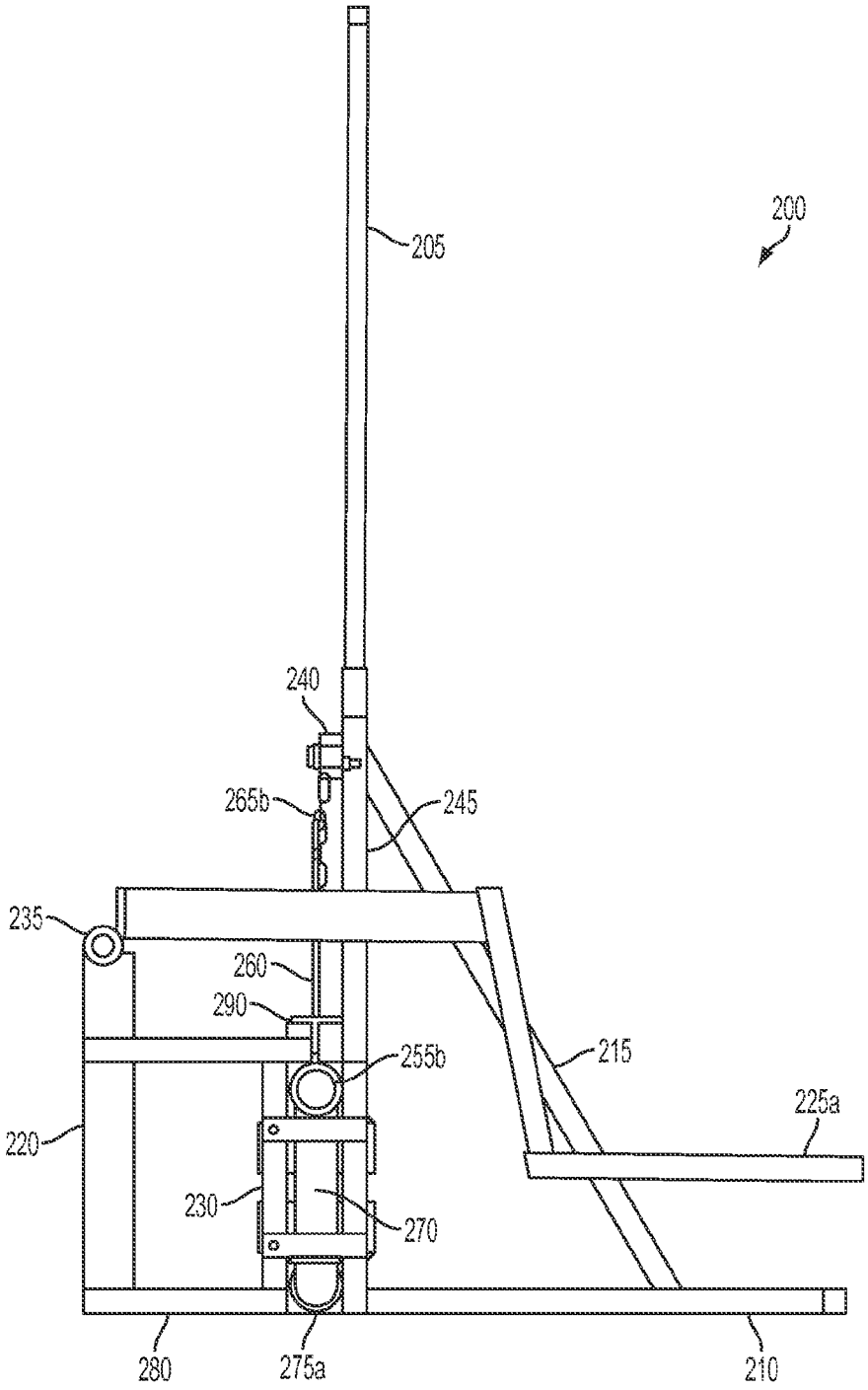
FIG. 2E depicts a side view of the exemplary treadle pump of FIG. 2A.
Figure 3A:
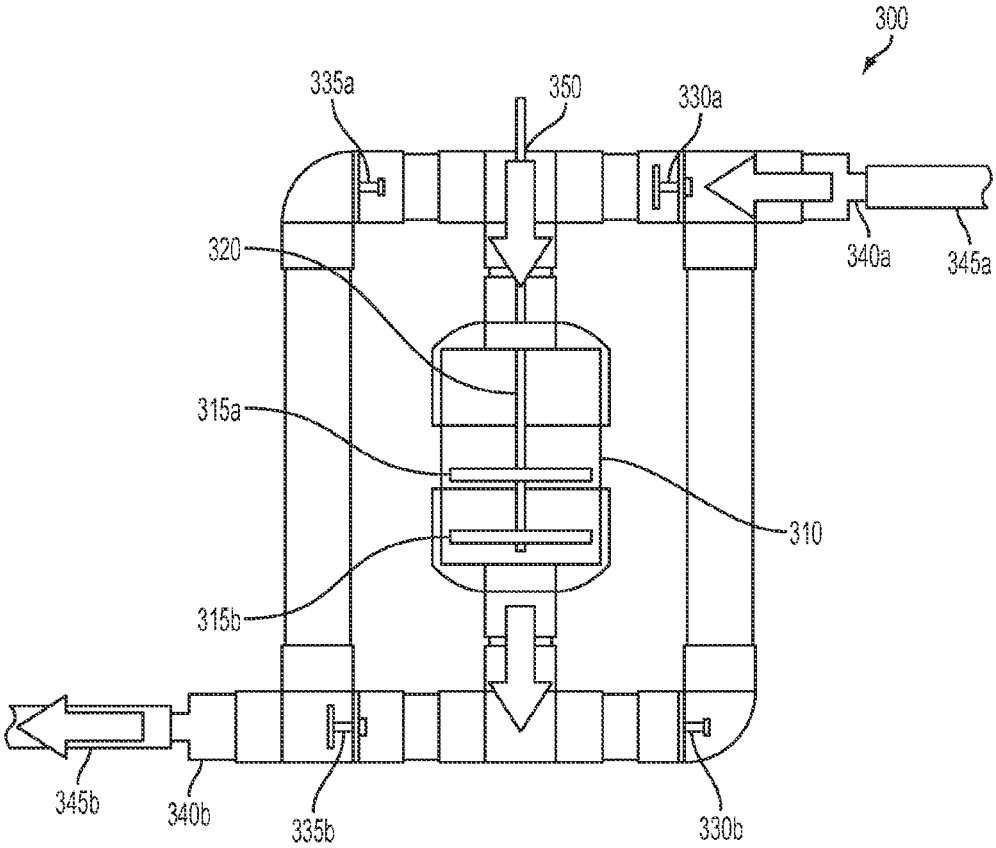
FIG. 3A depicts an interior view of an exemplary dual-action cylinder and its associated piping and valves when the piston is pushed down.
Figure 3B:
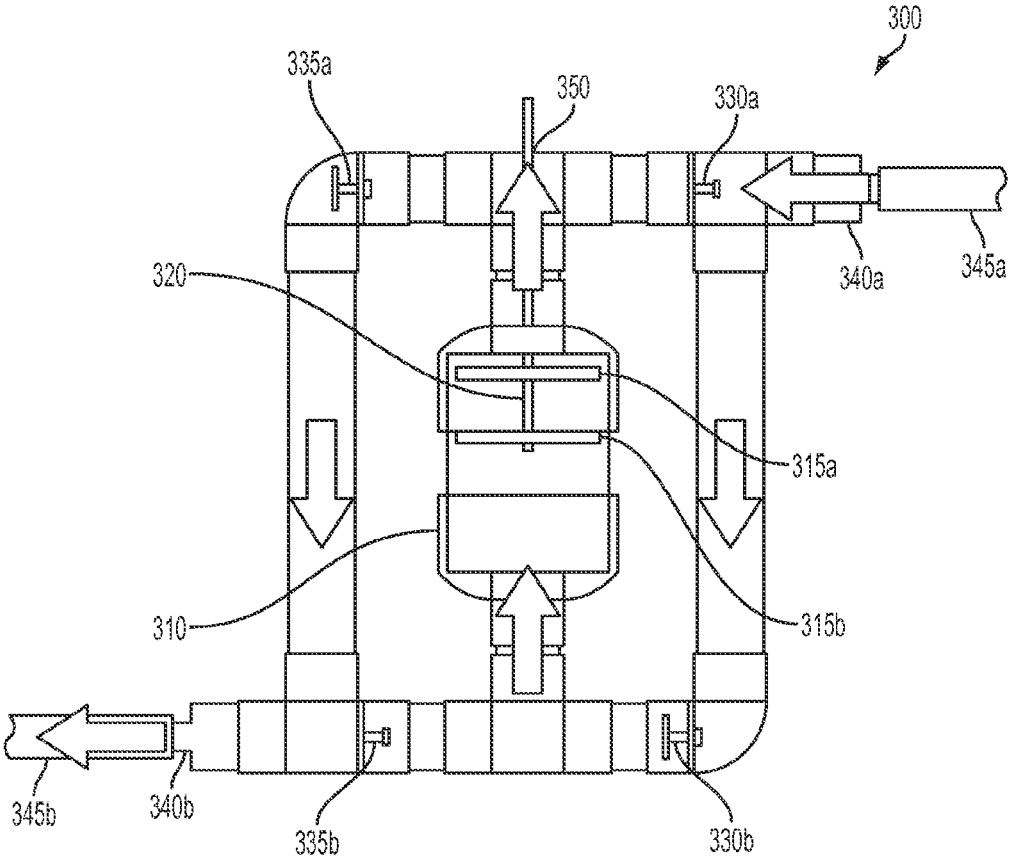
FIG. 3B depicts an interior view of the exemplary dual-action cylinder of FIG. 3A and its associated piping and valves when the piston is pulled up.

In one embodiment of the present invention, a human-powered apparatus for pumping and distributing water 200 comprises a pump. In embodiments of the invention, the pump is a positive-displacement pump which may be, for example but limited to, a pump which causes the movement of a fluid by trapping a fixed volume of the fluid and then forcing/displacing that trapped volume of fluid into a discharge pipe. The positive displacement pump, in an embodiment of the invention, comprises a single dual-action cylinder 250 and piping 275*a* (FIGS. 2B, 2C and 2E) and 275*b* (FIGS. 2B, 2C and 2D). The interior of the exemplary pump 300 is illustrated by FIGS. 3A-B, displaying a single dual-action cylinder 310, a piston 315*a* and 315*b*, and a plurality of valves 330*a*, 330*b*, 335*a*, and 335*b*. A positive-displacement pump causes the movement of a fluid by trapping a fixed volume of the fluid and then forcing/displacing that trapped volume of fluid into a discharge pipe. Some positive-displacement pumps use an expanding cavity on the suction side and a decreasing cavity on the discharge side. Liquid flows into the pump as the cavity on the suction side expands, and then flows out of the pump through the discharge as the cavity collapses. The volume of fluid pumped is constant through each cycle of operation. Unlike centrifugal pumps, positive-displacement pumps are constant flow machines, which can theoretically produce the same level of flow at a given speed (measured in pump cycles per minute) no matter what the level of discharge pressure is.

In embodiments of the present invention, the positive-displacement pump 300 comprises a sole dual-action cylinder 310 and a piston 315*a* and 315*b*. This dual-action cylinder 310 is different than the single-action cylinders found in existing treadle pumps. In these existing pump designs, the single-action cylinder always contains air in the cavity on one side of the piston and always contains water (or other liquid to be pumped) in the cavity on the other side of the piston. As the piston is pulled up, it displaces air, creating suction which causes water to fill the cylinder. The piston then displaces water as the piston is pushed down, and the cylinder again fills with air. In contrast, the dual-action cylinder 310 contains water in each of the cavities on each side of the piston 315*a* and 315*b*. Thus, unlike the single-action cylinders found in conventional treadle pumps, the dual-action cylinder 310 pumps water into the discharge piping upon both the up strokes and down strokes of the piston 315*a* and 315*b*. As shown by the arrows depicted within FIG. 3A, which represent the flow of water through the pump 300, as the piston 315*a* and 315*b* is pushed down, water fills the upper cavity as the water in the lower cavity is displaced. Moreover, as shown by the arrows depicted within FIG. 3B, which represent the flow of water through the pump 300, as the piston 315*a* and 315*b* is pulled up, water is displaced from the upper cavity while the lower cavity fills with water. This allows the sole dual-action cylinder 310 to pump water at an identical flow rate as a pump with two single-action cylinders, allowing a reduction in the size and weight (and thus increasing the portability) of the treadle pump 300.

Dual-Action Cylinder and Piston of the Pump

In embodiments of the present invention, the dual-action cylinder 310 is comprised of PVC pipe, a low-cost material which is lightweight and durable in water. However, the dual-action cylinder 310 could be comprised of any suitable material, including, but not limited to steel, PVC, uPVC, wood, bamboo, or molded plastics such as PMMA, Acetal HDPE, ABS, thermoplastic elastomer, and nylon, for example. The structure of the cylinder 310 must be sufficiently strong to resist the internal pressure caused by the fluid in the cylinder 310. In some embodiments of the invention, the PVC pipe used as the material for the dual-action cylinder 310 is 4 inch ASTM D2241 PVC pipe with a wall thickness of 2.5 millimeters and an inner diameter of 0.102 meters. However, the dual-action cylinder 310 could be comprised of any material of different dimensions that is capable of withstanding the pressures generated within the cylinder 310.

The piston 315*a* and 315*b* of the present invention must maintain a seal around its diameter and against the interior wall of the cylinder 310 to ensure volumetric efficiency in propelling fluid through the pump 300. However, the friction generated by the piston 315*a* and 315*b* against the interior wall of the cylinder 310 must be low enough to avoid unnecessarily sacrificing power efficiency.

In various embodiments of the invention, the piston 315*a* and 315*b* may be, for example, a double PVC piston, a double metal piston, a single PVC piston, and a single metal piston. In certain embodiments, and as illustrated in the exemplary embodiments of FIGS. 3A-B, the piston 315*a* and 315*b* is a double PVC piston 315*a* and 315*b* comprising two circular discs 315*a* and 315*b* of PVC connected by a piston rod 320, with a 1.35 inch vertical gap between the discs. This design maintains minimal leakage while reducing friction between the piston discs 315*a* and 315*b* and the interior wall of the cylinder 310. When incorporated into a 4-inch cylinder 310 with an interior diameter of 4.025 inches, there is a clearance of 0.02 inches between the cylinder 310 and the PVC discs of the piston 315*a* and 315*b*. However, other materials, such as steel, rubber, and molded plastics such as PMMA, Acetal HDPE, ABS, thermoplastic elastomer, and nylon, for example, could be incorporated into the piston 315*a* and 315*b*. Other designs, such as a single-disc piston design, could be used as an equivalent to the exemplary double PVC piston design illustrated in 315*a* and 315*b*.

In some embodiments of the invention, the piston rod 320 that connects the two PVC discs of the piston 315*a* and 315*b* is comprised of 0.25 inch diameter solid metal rod. However, the piston rod 320 could be comprised of any equivalent material, such as wood, bamboo, iron, steel, or other metals, for example, and could be sized in varying dimensions depending on the size of the cylinder 310 and the piston 315*a* and 315*b*.

In an embodiment, to allow the piston rod 320 to be connected to both the piston 315*a* and 315*b* itself as well as to the treadles, an opening 350 is constructed in a segment of the piping fittings into which the piston rod 320 can be inserted. In certain embodiments of the invention, the opening 350 is a hole of between 0.1 inches and 0.5 inches in diameter into which the piston rod 320 can be inserted. It is essential that air is not allowed to leak into the pump 300 through this opening 350, which can cause the pump 300 to pull air into the piping and push water out through the opening 350, leading to the pump 300 losing its prime. In one embodiment of the invention, water can be continuously poured onto this opening 350 during operation of the pump 300 in order to ensure that air does not leak into the piping.

In some embodiments of the invention, a seal is positioned around the piston rod 320 at the opening 350 in the piping or fittings to ensure that no leakage occurs. In one embodiment, as depicted by FIGS. 2A-E, the seal comprises an open-surface container 290 in the form of a ring that seals at the top of the pump around the piston rod 260 and extrudes upward, creating an open-surface container 290 for water to sit on top of the pump. The water in this open-surface reservoir 290 can be replenished as needed, insuring that only water, not air, is pulled into the pump. In another embodiment, the seal is a rubber or plastic ring placed around the piston rod 320 and constrained to the inside of the opening 350 to prevent air leakage.

In embodiments of the present invention, and as illustrated by FIGS. 2A-E, the piston rod 260 is attached to a first one of the treadles 225*b* through a slot machined into the first treadle 225*b* and secured with an eye nut on the end of the piston rod 260 and a nut underneath the first treadle 225*b*. This first treadle 225*b* is then connected to a rocker 240 by a chain 265*a*, and the second treadle 225*a* is connected to the rocker 240 with a chain 265*b* and connected to the pump with an eye bolt substituted in place of the piston rod and eye nut combination. As the operator of the pump pushes down on the first treadle 225*b*, the second treadle 225*a* is brought up. As shown in FIG. 3A, this causes the piston 315*a* and 315*b* to be pushed down within the dual-action cylinder 310. As the operator pushes down on the second treadle 225*a*, the first treadle 225*b* is pulled up. As illustrated by FIG. 3B, this causes the piston 315*a* and 315*b* to be pulled up within the dual-action cylinder 310.

The water to be pumped by the piston 315*a* and 315*b* in the dual-action cylinder 310 is commonly extracted from wells, ponds, or other natural wetlands, and often contains sediment such as sand, dust, or dirt, especially during the dry seasons of developing countries. This sediment wears at the interface between the piston 315*a* and 315*b* and the cylinder 310, possibly causing erosion of the piston 315*a* and 315*b* and/or the dual-action cylinder 310 itself. In certain embodiments of the invention, the piston 315*a* and 315*b* has a life-cycle of at least four months, at least six months, at least eight months, or at least twelve months. In certain embodiments of the invention, the cylinder 310 has a life-cycle of at least ten months, at least a year, at least eighteen months, or at least two years. In embodiments of the invention, the piston 315*a* and 315*b* and cylinder 310 are modular components which can be individually repaired or replaced when maintenance is required.

To prevent sediment from a water source from entering the piping 270 of the apparatus 200 and causing erosion, in some embodiments of the invention, a foot valve is placed in the piping or hosing of the well or other water source from which water is being drawn. The foot valve is a one-way valve installed on the end of the piping near the bottom of the well or other water source which prevents water from flowing backwards out of the piping back into the well or other water source once an attached pump has stopped operating. In these embodiments, the foot valve is attached to a net, strainer, or other equivalent component which catches sediment and prevents that sediment from being sucked up with the water that is drawn into the piping 270 of the apparatus 200. The net or strainer may be comprised, for example, of plastic mesh, fabric, metal, or any other suitable material for preventing sediment from being drawn into the piping 270 of the apparatus 200.

Piping and Fittings of the Pump

In one embodiment of the present invention, and as illustrated by FIGS. 2A-E, the positive-displacement pump of the apparatus 200 comprises piping 270 used to transport water or other liquids from an inlet 255*b* into the pump's cylinder 250 and then from the cylinder 250 to be dispensed from an outlet 255*a*. In certain embodiments of the invention, the piping 270 is comprised of PVC pipe. However, the piping could be comprised of other materials, such as, for example, steel, iron, copper, other metals, steel, or plastics such as PMMA, Acetal HDPE, ABS, thermoplastic elastomer, nylon, and other molded plastics, for example. In various embodiments, the piping 270 has an inner diameter of about 0.5 inches to about 2.5 inches. In a certain embodiment, the piping has an inner diameter of 1.5 inches.

In embodiments of the present invention, the exterior of the PVC pipe of the dual-action cylinder 250 and other PVC piping 270 of the positive-displacement pump is coated to protect from degradation caused by ultraviolet (UV) radiation. UV rays can affect the structure of the PVC molecules on the surface of the cylinder 250, resulting in color changes, an increase in tensile strength, and a decrease in impact strength. To protect against this degradation, a coating is applied to the surface of the cylinder 250 and piping 270. In certain embodiments, the coating is a water-based latex paint that absorbs light, although other UV-resistant coatings could be applied to the cylinder 250 and piping 270. In embodiments of the present invention, the dual-action cylinder 250 and other piping 270 of the apparatus 200 may be composed of unplasticized polyvinyl chloride (uPVC), which has strong resistance against chemicals, sunlight (including UV radiation), and oxidation from water.

In certain embodiments of the present invention, the human powered apparatus 200 comprises fittings 275*a* and 275*b*. The fittings 275*a* and 275*b* connect segments of the piping 270 to each other as well as to components such as the dual-action piston cylinder 250. In certain embodiments of the invention, the fittings 275*a* and 275*b* are comprised of PVC. However, the fittings 275*a* and 275*b* could be comprised of other materials, such as, for example, steel, iron, copper, other metals, or plastics such as PMMA, Acetal HDPE, ABS, thermoplastic elastomer, nylon, and other molded plastics. The fittings 275*a* and 275*b* may comprise tee fittings, end caps, elbow fittings, cross fittings, reducing bushings, and/or threaded couplings for attachment to hosing. In certain embodiments, the fittings 275*a* and 275*b* are PVC fittings with an inner diameter of about 0.5 inches to about 2.5 inches.

Valves of the Pump

In one embodiment of the present invention, and as illustrated by FIGS. 3A-B, the positive-displacement pump 300 comprises a plurality of valves 330*a*, 330*b*, 335*a*, and 335*b*. The plurality of valves 330*a*, 330*b*, 335*a*, and 335*b* are one-way valves that serve either to allow water to enter a cavity of the dual-action cylinder 310 from the inlet piping 340*a* while that cavity expands, such as valves 330*a* and 330*b*, or to allow water to escape from a cavity of the dual-action cylinder 310 into the outlet piping 340*b* while that cavity contracts, such as valves 335*a* and 335*b*. Each of the two sides of the dual-action cylinder 310 is connected to two valves, with the top of the dual-action cylinder 310 being connected to valves 330*a* and 335*a*, and the bottom of the dual-action cylinder 310 being connected to valves 330*b* and 335*b*.

One of the valves on each side of the dual-action cylinder 310 (valves 330*a* and 330*b* for the top and bottom sides of the cylinder 310, respectively) is connected to the inlet piping 340*a* and opens to allow water from the inlet piping 340*a* to enter that side of the dual-action cylinder 310 while the cavity on that side of the dual-action cylinder 310 expands, and then closes to prevent water from being pumped back into the inlet piping 340*a* as that cavity contracts. FIG. 3A, for example, illustrates valve 330*a* opening to allow water (represented by the arrows depicted within FIG. 3A) to fill the upper cavity of the cylinder 310 from inlet piping 340*a* as that upper cavity expands and piston 315*a* and 315*b* is pushed down, while valve 330*b* is closed to prevent water from escaping back from the lower cavity of the cylinder 310 into inlet piping 340*a* as that lower cavity contracts. Conversely, FIG. 3B illustrates valve 330*b* opening to allow water (represented by the arrows depicted within FIG. 3B) to fill the lower cavity of the cylinder 310 from inlet piping 340*a* as that lower cavity expands and piston 315*a* and 315*b* is pulled up, while valve 330*a* is closed to prevent water from escaping back from the upper cavity of the cylinder 310 into inlet piping 340*a* as that upper cavity contracts.

The other one of the valves on each side of the dual-action cylinder 310 (valves 335*a* and 335*b* for the top and bottom sides of the cylinder 310, respectively) is connected to the outlet piping 340*b* and closes to allow water to fill that side of the dual action cylinder 310 as the cavity on that side of the dual-action cylinder 310 expands, and then opens to allow water to be pumped into the outlet piping 340*b* as that cavity contracts. FIG. 3A, for example, illustrates valve 335*b* opening to allow water (represented by the arrows depicted within FIG. 3A) to be pumped from the lower cavity of cylinder 310 into the outlet piping 340*b* as that lower cavity contracts as piston 315*a* and 315*b* is pushed down, while valve 335*a* is closed so that the upper cavity of cylinder 310 fills with water as that upper cavity expands. Conversely, FIG. 3B illustrates valve 335*a* opening to allow water (represented by the arrows depicted within FIG. 3B) to be pumped from the upper cavity of cylinder 310 into the outlet piping 340*b* as that upper cavity contracts as piston 315*a* and 315*b* is pulled up, while valve 335*b* is closed so that the lower cavity of cylinder 310 fills with water as that lower cavity expands.

Figure 4A:
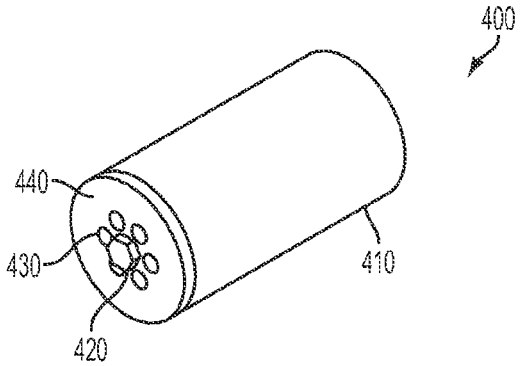
FIG. 4A depicts a perspective view of an exemplary lift-check non-return valve.
Figure 4B:
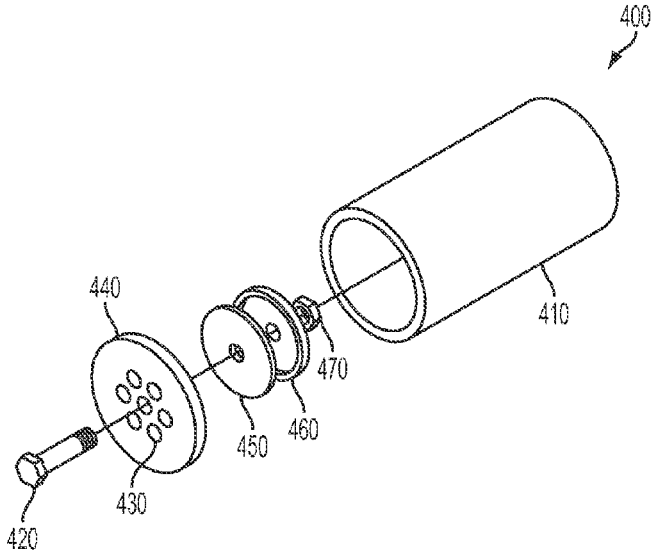
FIG. 4B depicts an exploded view of the exemplary lift-check non-return valve of FIG. 4A.

In various embodiments of the present invention, the types of the plurality of valves 330*a* and 330*b*, and, 335*a* and 335*b* may be valves, such as, but not limited to swing-check non-return valves and lift-check non-return valves. In certain embodiments, the plurality of valves 330*a* and 330*b*, and, 335*a* and 335*b* are lift-check non-return valves. As illustrated by FIGS. 4A-B, the lift-check non-return valve 400 comprises a first circular disc 440 containing one or more holes 430 spaced symmetrically around the center of the first circular disc 440, known as the valve plate 440. In certain embodiments a bolt 420 is inserted into a hole through the center of the valve plate 440, the bolt 420 comprising a head on a first end of the bolt 420, and the head being larger than the hole through the center of the valve plate 440. The head of the bolt 420, which is located on a first side of the valve plate 440, prevents the bolt 420 from sliding completely through the valve plate 440. The other end of the bolt 420 is attached to a second circular disc 450 and 460, located on a second side of the valve plate 440, through a hole in the center of the second disc 450 and 460 and secured with a nut 470. The second disc 450 and 460 is of sufficient size to cover the one or more holes 430 spaced symmetrically around the center of the valve plate 440. The valve 400 opens when the head of the bolt 420 is pressed against the valve plate 440, which creates space between the valve plate 440 and the second circular disc 450 and 460, allowing water or other liquid to flow through the holes 430 in the valve plate 440. The valve 400 closes when the second circular disc 450 and 460 is pressed against the valve plate 440, which blocks the holes 430 in the valve plate 440 and prevents water or other liquid from flowing through the holes 430 in the valve plate 440.

A greater number of holes 430 of the same diameter in the valve plate 440 will allow a greater volume of fluid to pass through the valve plate 440, increasing the ease and efficiency of pumping. In various embodiments of the present invention, each valve plate 440 has from two to eight holes 430 spaced equidistantly around the center of the valve plate 440. In a certain embodiment, each valve plate 440 contains six holes 430 spaced symmetrically around the center of the valve plate 440.

In certain embodiments, the plurality of valves 400 can be comprised of various materials including steel, other metals, PVC, uPVC, plastics such as PMMA, Acetal HDPE, ABS, thermoplastic elastomer, nylon, other molded plastics, and rubber, for example. In certain embodiments, the valve plates 440 are comprised of PVC, the bolts 420 are steel shoulder bolts with hexagonal heads, and the second circular disc is comprised of rubber 450 and PVC 460. The PVC in the second circular disc is a circle of flattened PVC 460 with a countersunk center which fits the shape of the rubber 450. In this embodiment, the PVC in the second circular disc 460 aids the rigidity of the rubber in the second circular disc 450 and prevents the shape of the rubber 450 from distorting when exposed to force. However, the components of the valves 400 could be comprised of any suitable material, including but not limited to PVC, uPVC, plastics such as PMMA, Acetal HDPE, ABS, thermoplastic elastomer, nylon, and other molded plastics, rubber, steel, and other metals, for example.

In one embodiment of the invention, the diameter of a valve plate 440 is equal to the outer diameter of the piping 410. In another embodiment of the invention, the diameter of the valve plate 440 is equal to the inner diameter of the piping 410. The valve plates 440 are attached to the piping 410 by gluing, cementing, or other equivalent methods.

Like the piston and cylinder, the plurality of valves 400 also are subject to erosion and wear, with one source being the friction generating by the movement of the bolt 420 against the valve plate 440. In certain embodiments, each of the plurality of valves 400 has a life-cycle of at least a year, at least eighteen months, or at least two years. In embodiments of the invention, the plurality of valves 400 are modular components which can be individually repaired or replaced when maintenance of the plurality of valves 400 is required.

Hosing of the Pump

Figure 5:
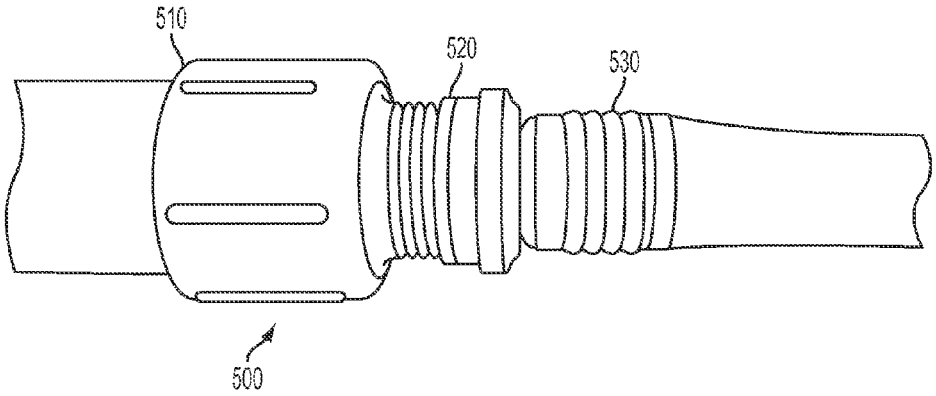
FIG. 5 depicts a hose coupled to piping via a threaded coupling.
Figure 6:
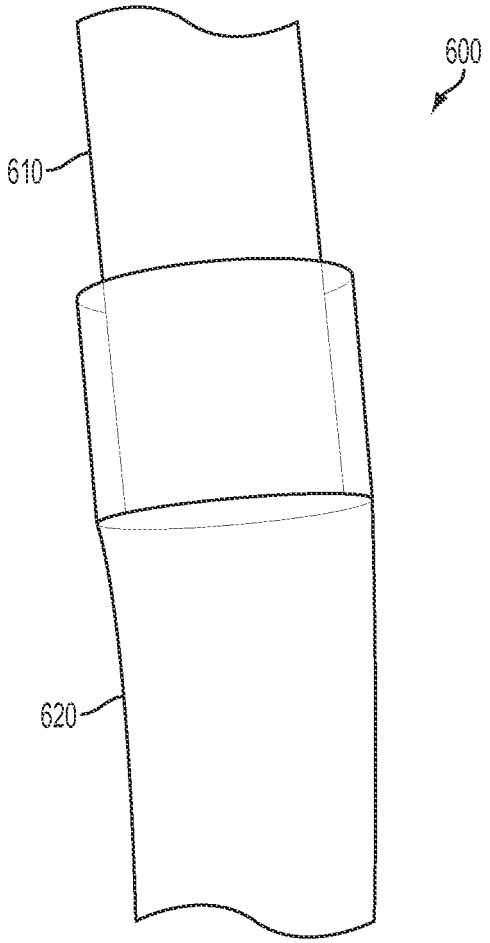
FIG. 6 depicts a hose slip fitted over a segment of piping.

In certain embodiments of the present invention, the human powered apparatus comprises hosing. As illustrated by FIGS. 3A-B, in certain embodiments, the hosing 345*a* and 345*b* is connected to the pump 300 via reducing bushings 340*a* and 340*b*. In certain embodiments, a reducing bushing 340*a* or 340*b* has an inner diameter of at least about 0.5 inches to about 1.0 inches. As illustrated by FIG. 5, in certain embodiments, the connection 500 can consist of the hosing 530 being attached to the piping of the pump 510 using a threaded coupling 520. In other embodiments, as illustrated by FIG. 6, the connection 600 can consist of the hosing 620 being slip fitted over a segment of piping 610 fitted into a reducing bushing. In certain embodiments, the hosing is vinyl hosing 620 slip fitted over a segment of PVC piping 610, wherein the outer diameter of the piping 610 is greater than the inner diameter of the vinyl hosing 620, ensuring a water-tight fit. The vinyl hosing 620 is malleable enough to be forced around the piping 610 but not so free-forming that water or other fluids can leak out, even at high pressures. However, the hosing 620 could be comprised of other materials, such as natural or synthetic rubbers, PVC, polyethylene, nylon, Teflon, stainless steel, other metals, fabrics, or polymers, for example.

In certain embodiments, as shown in FIG. 3A-B, the hosing comprises an inlet hose 345*a* to draw water from a water source and an outlet hose 345*b* to direct the pumped water to a desired location. In one embodiment, the inlet hose 345*a* comprises both a primary inlet hose, connected to a well or other water source, and a shorter, secondary inlet hose used for priming the pump 300. Once the pump 300 has been filled with water through the secondary inlet hose, the secondary hose can be clamped or closed off, and the pump 300 will pull suction from the primary inlet hose located in the well or other water source.

In certain embodiments of the present invention, the water sources from which water is pumped comprise wells, ponds, lakes, rivers, streams, creeks, and other natural wetlands and waterways. In various embodiments of the invention, the water source is a well with a depth of at least seven meters below ground. In certain embodiments, the well is a small diameter tube well that has been manually drilled through the ground using a hand auger or drill. In embodiments of the invention, the inlet hosing 345*a* may be fixed to the well.

In one embodiment of the present invention, the human-powered apparatus 200 for pumping and distributing water is lightweight, able to be transported on a motorcycle and carried by hand. In certain embodiments of the invention, the apparatus 200, when fully assembled, weighs less than 22 kilograms, less than 20 kilograms, less than 17 kilograms, or less than 15 kilograms. To further improve the portability of the apparatus 200, in certain embodiments, the pump can be removed from the frame of the apparatus 200 to allow the two components to be transported separately. In one embodiment of the invention, one or more wheels may be attached to the apparatus 200, allowing the apparatus 200 to be tilted and wheeled across smooth to moderately smooth terrain. In another embodiment of the invention, the width of the frame may be widened, causing the apparatus 200 to occupy a larger amount of space, but increasing stability during operation. In other embodiments of the invention, the height of the components of the apparatus 200 may be shortened, causing the apparatus 200 to occupy a smaller volume and increasing the stability of the apparatus 200 during operation.

In certain embodiments of the invention, the apparatus 200 is capable of propelling water from a depth of at least seven meters below ground level to a vertical height of seven additional meters above ground level, and propelling water to a horizontal length of at least one hundred meters. In certain embodiments of the invention, the flow rate of water pumped by the apparatus 200 is at least 30 liters per minute, at least 35 liters per minute, or at least 40 liters per minute when the treadles 225*a* and 225*b* are operated at 30 cycles per minute.

Methods of Operation

In one embodiment of the present invention, a method for pumping and distributing water by operating a human-powered apparatus 200 comprises priming a pump of the apparatus 200 by manually inserting water into the dual-action cylinder 250 of the pump while simultaneously operating the pump, and then pumping water with the apparatus 200 by operating the two treadles 225*a* and 225*b* of the apparatus 200. "Priming" may refer to, for example but is not limited to, the process of inserting water into a pump while the pump is simultaneously operated. This process fills the pump with water and forces air out of the pump and its attached hosing so that the pump and hosing only contain mostly water. Once the air initially contained within the pump has been replaced with water, the pump is capable of generating enough suction to pull water from a well or other source, and is referred to as "primed."

Initially, the pump and the inlet hosing of the pump will primarily or solely contain air, and operating the pump in this state will not produce sufficient suction to draw water from a well or other water source into the pump. Priming is a process in which water is manually inserted into the pump while the pump is simultaneously operated, filling the pump with water and pushing the air out of the pump and hosing so that the pump and hosing only contain mostly water, at which point the pump can generate enough suction to pull water from a well or other source.

In one embodiment of the present invention, priming the pump by manually inserting water into the pump comprises a first person pouring from about 1 liter of water to about 5 liters of water into the inlet hosing of the pump at a location vertically higher than the pump while a second person operates the treadles of the pump. In certain embodiments of the invention, approximately 3.4 liters of water are required to prime the pump. The amount of pumping necessary to draw out the air initially present in the inlet hosing and the pump is dependent upon the length of the inlet hosing. In some embodiments, approximately one minute of pumping is required to draw the air out the apparatus and prime the pump.

In certain embodiments of the present invention, the water used to prime the pump is inserted into a relatively short secondary inlet hose used solely as a mechanism for priming the pump. Once the pump has been filled with water, the secondary inlet hose can be clamped or otherwise closed off, and the pump will pull suction from the primary inlet hose fixed to the well or other water source. After several minutes of pumping, the air will completely leave the system.

In embodiments of the present invention, the human-powered apparatus 200 may be simultaneously operated by two people. The two operators of the pump may each stand on both of the treadles 225*a* and 225*b*, increasing the force applied to the apparatus 200 and the flow rate of the water pumped by apparatus 200. In some embodiments, each of the operators stands on treadles 225*a* and 225*b*, the two operators facing each other on either side of handle 205.

Methods of Manufacturing

In one embodiment of the present invention, a method for manufacturing a human-powered apparatus for pumping and distributing water comprises welding a frame together and welding each of the two treadles together. In one embodiment, lengths of 1×1 inch angle iron and 1×1 inch steel channel are cut with a chop saw, then welded together to assemble the frame. Lengths of 1×2 inch steel channel are prepared with a chop saw and angle grinder, then welded together to form two treadles.

In one embodiment of the present invention, circular discs of PVC are manufactured for use in the piston and in the plurality of valves of the apparatus by heating PVC pipe to above the glass transition temperature of PVC, pressing the heated PVC pipe between two flat plates of glass, and allowing the heated PVC pipe to cool slowly into a flattened sheet. Circular discs are then cut from the flattened sheet of PVC using a hole saw or a band saw, and then shaped to a specific fit using sandpaper or other abrasive. In one embodiment of the invention, the glass transition temperature of PVC is approximately 80 degrees Celsius, and the softening range of PVC is from about 85 degrees Celsius to about 165 degrees Celsius. In certain embodiments of the invention, the PVC pipe is heated to above the glass transition temperature using an oven. However, other devices for heating the PVC may be used, as well as other methods for flattening the PVC as an alternative to pressing the heated PVC between glass plates. For example, any rigid, flat plates composed of a suitable material, such as steel, iron, or other metals, could be used to flatten the heated PVC pipe into sheets.

In one embodiment of the invention, the plurality of valves and the piston are assembled from the manufactured circular discs of PVC. The plurality of valves are then glued to the piping, and the frame, treadles, and pump are connected to assemble the apparatus.

The following Examples are only illustrative. It will be readily seen by one of ordinary skill in the art that the present invention fulfills the objectives set forth above. After reading the foregoing specification, one of ordinary skill will be able to effect various changes, substitutions of equivalents, and various other embodiments of the invention as broadly disclosed therein. It is therefore intended that the protection granted herein be limited only by the definition contained in the appended claims and equivalents thereof.

EXAMPLE 1

Figure 1B:
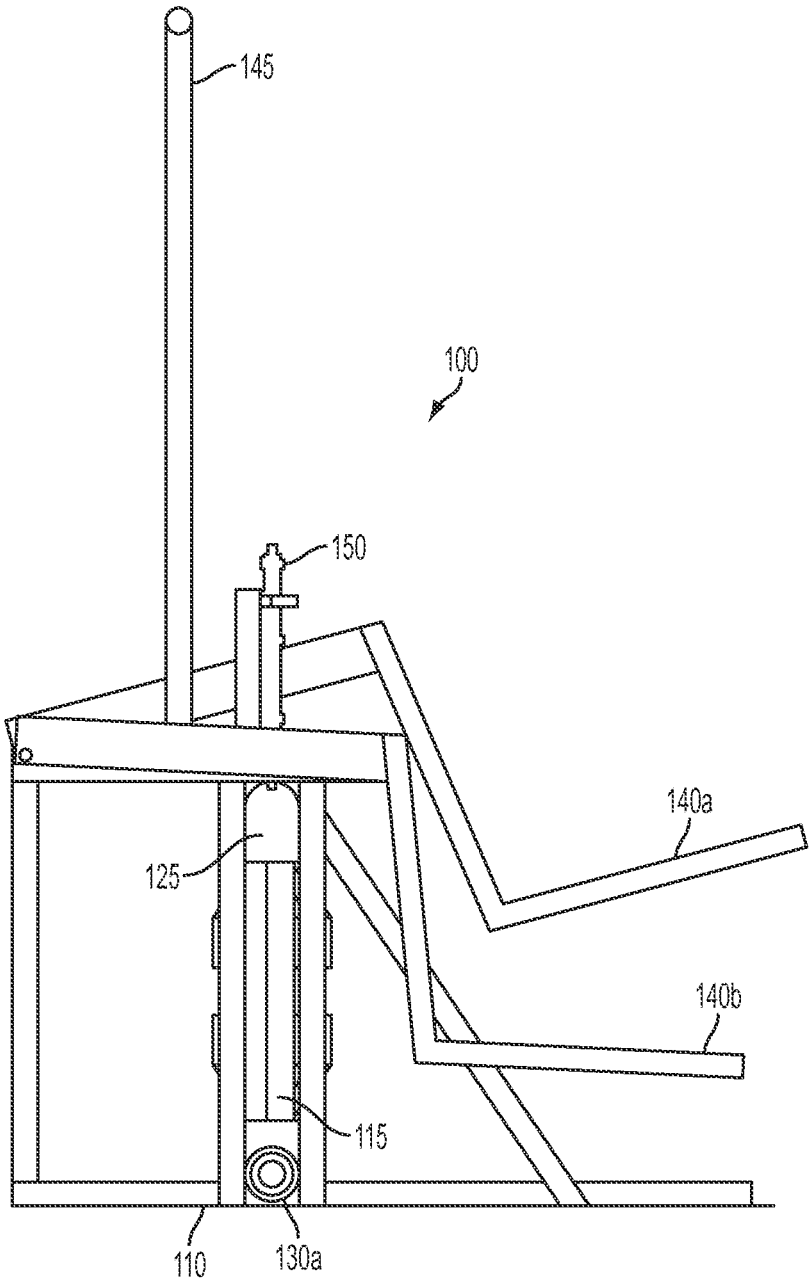
FIG. 1B depicts a side view of the exemplary treadle pump of FIG. 1A.

FIGS. 1A and 1B illustrate a first exemplary single-cylinder treadle pump apparatus 100 of the present invention. The single-cylinder treadle pump apparatus 100 comprises a frame 110, piping 115, a single dual-action cylinder 120, fittings 125, treadles 140*a* and 140*b*, and a handle 145. The treadles 140*a* and 140*b* are connected to the frame 110 via rocker 150, and each treadle 140*a* and 140*b* is attached to the rocker 140 with a bar having two pivot points, as depicted by 165*a* and 165*b*, respectively. The treadles 140*a* and 140*b* drive piston rod 155, which is inserted through a hole in the fittings 125 into the dual-action cylinder 120. The piping 115 of the apparatus 100 features reducing bushings 130*b* and 130*a*, which can be connected to an inlet hose from a water source and an outlet hose to the area to be irrigated, respectively.

EXAMPLE 2

FIGS. 2A-E illustrate a second exemplary single-cylinder treadle pump apparatus 200 of the present invention. The single-cylinder treadle pump apparatus 200 comprises a handle 205 for use by the operator of the apparatus 200 for greater stability during operation, a rectangular housing 230 holding pump components such as the piping 270, dual-action cylinder 250, and fittings 275*a* and 275*b*, and two treadles 225*a* and 225*b*. The operator's weight is borne by operator supports 210 and 215, the pivot 235 about which the treadles 225*a* and 225*b* rotate is supported by back supports 220 and 280, and the rocker 240 is supported by rocker support 245 and attached to the treadles 225*a* and 225*b* by chains 265*b* and 265*a*. The treadles 225*a* and 225*b* drive piston rod 260, which is inserted in and out of dual-action cylinder 250 to drive the piston which pumps water in from the water source connected to inlet piping 255*b* and out of the apparatus 200 from outlet piping 255*a* to an area to be irrigated. An open-surface container 290 for containing water surrounds piston rod 260 at the location of the opening where the piston rod 260 enters fitting 275*b*, preventing air from leaking into the pump during operation.

What is claimed is:

1. A human-powered apparatus for pumping and distributing water, comprising:

a frame;

two treadles, wherein the two treadles are connected to the frame by a rocker; and a pump, wherein the pump is a positive-displacement pump which comprises:

a single dual-action cylinder;

a piston, wherein the two treadles are connected to the piston by a piston rod;

piping, wherein the piping comprises an opening for the piston rod;

a seal positioned around the piston rod at the opening in the piping, wherein the seal comprises an open-surface container capable of containing water; and a plurality of valves, wherein the plurality of valves are swing-check non-return valves or lift-check non-return valves, and wherein the positive-displacement pump is configured to pump water from the single dual-action cylinder upon both up strokes and down strokes of the piston.

2. The apparatus of claim 1, further comprising hosing.

3. The apparatus of claim 2, wherein the hosing comprises an inlet hose and an outlet hose.

4. The apparatus of claim 3, wherein the inlet hose and the outlet hose are vinyl hoses.

5. The apparatus of claim 3, wherein the inlet hose communicates with a water source.

6. The apparatus of claim 5, wherein the water source is a well.

7. The apparatus of claim 6, wherein the well is a small diameter tube well.

8. The apparatus of claim 1, wherein the apparatus weighs less than twenty kilograms.

9. The apparatus of claim 1, wherein the apparatus is capable of vertically propelling water at least seven meters and horizontally propelling water at least one hundred meters.

10. The apparatus of claim 1, further comprising fittings.

11. The apparatus of claim 1, wherein the frame is comprised of materials selected from the group consisting of steel, iron, PVC, angle iron, steel channel, solid steel rod, wood, and bamboo.

12. The apparatus of claim 1, wherein the treadles are comprised of materials selected from the group consisting of steel, iron, steel channel, angle iron, wood, and bamboo.

13. The apparatus of claim 1, wherein each of the plurality of valves is a lift-check non-return valve, and the lift-check non-return valve comprises:

a valve plate comprising a first disc containing holes spaced symmetrically around the center of the first disc;

a second disc of a size sufficient to simultaneously cover all of the holes spaced symmetrically around the center of the first disc, wherein the second disc is positioned on a first side of the valve plate; and a bolt inserted through both a hole located in the center of the valve plate as well as a hole located in the center of the second disc, the bolt comprising a head larger than the hole located in the center of the valve plate, wherein the head of the bolt is positioned on a second side of the valve plate.

14. The apparatus of claim 13, wherein the first disc is comprised of flattened PVC, and the second disc is comprised of rubber and flattened PVC.

15. The apparatus of claim 1, wherein the plurality of valves are comprised of materials selected from the group consisting of PVC, uPVC, molded plastic, steel, and rubber.

16. The apparatus of claim 1, wherein the piston is comprised of materials selected from the group consisting of PVC, uPVC, molded plastic, steel, and rubber.

17. The apparatus of claim 1, wherein the piping is PVC piping or uPVC piping.

18. The apparatus of claim 17, wherein the PVC piping has an inner diameter of about 0.5 inches to about 2.5 inches.

19. The apparatus of claim 1, wherein the apparatus is capable of pumping water at a flow rate of at least 35 liters per minute.

20. The apparatus of claim 1, wherein the open-surface container contains water.

21. The apparatus of claim 1, wherein the frame comprises a handle, a housing, and a support.

22. The apparatus of claim 1, wherein the dual-action cylinder is comprised of a material selected from the group consisting of PVC, uPVC, and molded plastic.

23. A human-powered method for pumping and distributing water by operating the apparatus of claim 1, comprising the steps of:

priming the pump of the apparatus by manually inserting water into the pump while simultaneously operating the pump; and pumping water using the apparatus by operating the two treadles.

24. The method of claim 23, wherein manually inserting water into the pump comprises pouring about 1 liter to about 5 liters of water into the pump.

25. The method of claim 23, further comprising the step of attaching the pump to inlet hosing fixed to a water source before priming the pump.

26. A method for manufacturing the apparatus of claim 1, comprising the steps of:

welding the frame together;

welding each of the two treadles together;

manufacturing circular discs of PVC for use in the piston and in the plurality of valves, wherein the manufacturing of circular discs comprises:

heating PVC pipe to above the glass transition temperature of PVC;

pressing the heated PVC pipe between flat glass plates and allowing the heated PVC pipe to cool into a flattened PVC sheet; and cutting circular discs from the flattened PVC sheet;

assembling the plurality of valves;

gluing the plurality of valves to the piping; and connecting the frame, treadles, and pump to assemble the apparatus.

27. The method of claim 26, wherein the PVC pipe is heated using an oven.

28. The method of claim 26, wherein a coating is applied to the pump to prevent degradation from ultraviolet rays.

29. The method of claim 26, wherein the coating is a water-based latex paint.

30. The human-powered apparatus of claim 1, wherein (a) the apparatus weighs less than twenty kilograms;

(b) the apparatus is capable of vertically propelling water at least seven meters and horizontally propelling water at least one hundred meters; and (c) the apparatus is capable of pumping water at a flow rate of at least 35 liters per minute.

31. The human-powered apparatus of claim 30, wherein the apparatus weighs less than fifteen kilograms.

32. The apparatus of claim 8, wherein the apparatus weighs less than fifteen kilograms.

* * * * *